US006923243B2

(12) United States Patent
Uebayashi et al.

(10) Patent No.: US 6,923,243 B2
(45) Date of Patent: Aug. 2, 2005

(54) ELECTROMAGNETIC DRIVE-TYPE DIE CASTING DECOMPRESSION VALVE, DRIVE METHOD FOR SUCH A VALVE, AND A DIE CASTING UNIT

(75) Inventors: Hidenori Uebayashi, Toyota (JP); Hajime Morimoto, Toyota (JP); Takashi Izuo, Toyota (JP); Takeshi Sakuragi, Toyota (JP); Keiichi Oikawa, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/845,390

(22) Filed: May 14, 2004

(65) Prior Publication Data

US 2004/0226679 A1 Nov. 18, 2004

(30) Foreign Application Priority Data

May 16, 2003 (JP) ..... 2003-138360
Jan. 20, 2004 (JP) ..... 2004-011517

(51) Int. Cl.[7] ..... B22D 17/20
(52) U.S. Cl. ..... 164/305; 164/410
(58) Field of Search ..... 164/305, 410; 425/420, 812

(56) References Cited

U.S. PATENT DOCUMENTS 2,785,448 A * 3/1957 Hodler ..... 164/305
3,349,833 A * 10/1967 Hodler ..... 164/113
4,586,560 A * 5/1986 Ikeya et al. ..... 164/457
4,986,338 A * 1/1991 Yamauchi et al. ..... 164/457
4,995,445 A * 2/1991 Shigyo ..... 164/305
5,314,002 A * 5/1994 VanRens et al. ..... 164/305
6,808,008 B2 * 10/2004 Kubota ..... 164/305

FOREIGN PATENT DOCUMENTS

| | | |
|---|---|---|
| JP | 2-84239 | 3/1990 |
| JP | 02-192866 | 7/1990 |
| JP | 2002-239704 | 8/2002 |
| JP | 2002-239705 | 8/2002 |
| JP | 2002-239707 | 8/2002 |

* cited by examiner

*Primary Examiner*—Jonathan Johnson
*Assistant Examiner*—Len Tran
(74) *Attorney, Agent, or Firm*—Finnegan, Henderson, Farabow, Garrett & Dunner, LLP

(57) ABSTRACT

An electromagnetic drive-type die casting decompression valve comprises a drive shaft, provided inside a drive block, driven by electromagnetic force from a solenoid, and a valve shaft, provided inside a valve block separate from the drive shaft, provided with a valve body on one shaft end. Also, a closing spring working jointly to urge the valve body in a closing direction is provided on the valve shaft, while an opening spring working jointly to urge the valve body in the opening direction is provided on the drive shaft. The valve block is also provided in a replaceable manner. According to this type of electromagnetically driven die casting decompression valve, bouncing is not caused at the time of closing a decompression valve, and it is also possible to significantly decrease maintenance time and repair costs even when problems arise, such as molten metal infiltrating into a valve body.

8 Claims, 9 Drawing Sheets

ELECTROMAGNETIC DRIVE-TYPE DIE CASTING DECOMPRESSION VALVE, DRIVE METHOD FOR SUCH A VALVE, AND A DIE CASTING UNIT

BACKGROUND OF THE INVENTION

1. Field of the Invention

The present invention relates to an electromagnetic drive-type die casting decompression valve, a drive method for such a valve and a die casting unit, and particularly to an improved structure for a decompression valve that can be used with a decompression die casting method.

2. Description of Related Art

In injection molding machines, such as die caster machines, casting is generally carried out using a low pressure die casting method or vacuum die casting method for carrying out injection molding by extracting gas inside a cavity being formed inside a mold at the time of injecting metallic material. This type of low-pressure die casting method is adopted in order to prevent variations in quality and defects in cast items due to contained gas. Specifically, if a metallic material in a molten or semi-molten state is injected and filled at high speed and low pressure into the inside of a cavity that is not in a low pressure or vacuum state, the metallic material becomes turbulent inside the cavity and gas is convoluted with the metallic material, as a result of which defects, such as blow holes, occur in the cast item.

In order to overcome this type of problem, techniques are known for suppressing gas contained in a cast item to prevent variations in quality and defects by casting a metallic material using a die casting unit employing a low-pressure die casting method.

For example, the specification of Japanese patent No. 1640217 discloses technology relating to a valve drive unit 5 used in die casting as shown in FIG. 8. Specifically, Japanese patent No. 1640217 discloses a valve drive unit 5 used in die casting, having a gas extraction valve 13 arranged in a gas extraction hole 12 leading from a cavity 11 inside a mold 10, where in a valve open state gas is guided to the outside of the mold 10 so as fill the inside of the cavity 11 with molten metal, and if a molten metal detection sensor 14 provided between the cavity 11 and the gas extraction valve 13 detects molten metal, the gas extraction valve 13 is closed. This valve drive unit 5 disclosed in Japanese patent No. 1640217 uses an air driven valve in the gas extraction valve 13, and implements an improved drive structure, to enable implementation of an opening and closing operation of the gas extraction valve in a short time.

Besides an air-driven decompression valve (gas extraction valve 13) adopted by the specification of Japanese patent application No. 1640217, there is also an electromagnetically driven decompression valve (refer, for example, to Japanese patent laid-open No. 2002-239704).

Closing of the decompression valve of the previously described die casting unit is preferably carried out as soon as possible after detection of molten metal by the molten metal detection sensor when filling the inside of the cavity with molten metal, from the point of view of preventing reduction of a degree of vacuum inside the cavity. The specification of Japanese patent application No. 1640217 and also the invention of Japanese patent laid-open No. 2002-239704 relate to improvement in opening and closing operation response of a decompression valve, and to improvement in quality of a cast item.

However, with the specification of Japanese patent application No. 1640217 and the invention disclosed in Japanese patent laid-open No. 2002-239704, in order to improve the opening and closing operation response of the decompression valve the valve is operated at high speed, which, means that there is a problem of the valve bouncing at the time of closing the decompression valve. As described previously, closing of the decompression valve is carried out in a state where molten metal has approached to directly in front of the decompression valve, which means that if the valve bounces there will be a problem of molten metal infiltrating to the inside of the decompression valve. In this case, it will be necessary to dismantle the entire decompression valve, requiring a long time to deal with the problem, and also incurring expensive repair costs.

There is also technology for preventing decompression valve bounce arising, as disclosed in the specification of Japanese patent application 1699815. Specifically, the invention disclosed in the specification of Japanese patent application 1699815 is fitted with an absorption plate moving in accordance with rising of the valve, at the time of a valve closing operation, thus absorbing valve movement energy using the absorption plate to prevent valve bounce. By adopting this type of structure, with the invention disclosed in the specification of Japanese patent application 1699815, shortening of valve operation time and closing of an exhaust vent are assured. However, changing a decompression valve to this type of structure increases the size of the decompression valve in line with installation of the absorption plate, and also increases manufacturing cost. Also, when the problem of molten metal infiltration arises, similarly to the invention disclosed in Japanese patent laid-open No. 2002-239704 and the specification of Japanese patent application No. 1640217, it will be necessary to dismantle the entire decompression valve, and since the structure is complicated, it will require time and repair expense to deal with problems arising in the related art.

SUMMARY OF THE INVENTION

An electromagnetically driven die casting decompression valve of the present invention, used for decompression of the inside of a cavity injection filled with molten metal in order to obtain a desired cast item, and fitted in an exhaust passage formed communicating with a cavity inside a mold, comprises a drive shaft, provided inside a drive block, driven by electromagnetic force from a solenoid, and a valve shaft, provided inside a valve block separate from the drive shaft, provided with a valve body on one shaft end, wherein a closing spring working jointly to urge the valve body in a closing direction is provided on the valve shaft, while an opening spring working jointly to urge the valve body in the opening direction is provided on the drive shaft, a shaft end surface of the drive shaft and shaft end surface of the valve shaft that is opposite to a valve mounting side are brought into contact by urging forces in opposite axial directions exerted by the closing spring and the opening spring, opening and closing of the decompression valve is carried out by driving the valve shaft connected to the dive shaft driven by the solenoid, and it is possible to replace the valve block.

It is preferable for the drive shaft and the valve shaft to be provided maintaining an equilibrium within a drive stroke from an open end to a closed end that the valve body is capable of being driven through, when not receiving electromagnetic force from the solenoid.

It is also possible to have a position detector for detecting current position of the drive shaft within the drive stroke from an open end to a closed end that the valve body is capable of being driven through, and to carry out equipment checks using electrical signals from the position detector.

It is also possible to fit respective permanent magnets to the open end and closed end of the drive shaft, and have the permanent magnets contribute towards reduction in power consumption of the solenoid by assisting stopping at a drive stroke end of the drive shaft driven by drive force generated by the solenoid.

Using the above described magnetically driven die casting decompression valve, it is also possible to implement inventions relating to a drive method and a die casting unit.

According to the present invention, it is possible to provide an electromagnetically driven die casting decompression valve, a drive method for such a valve and a die casting machine in which bouncing is not caused at the time of closing a decompression valve, and for which it is possible to significantly decrease maintenance time and repair costs even when problems arise, such as molten metal infiltrating into a valve body.

DESCRIPTION OF THE PREFERRED EMBODIMENT

Preferred embodiments of the present invention will be described using the drawings. Device structure other than the decompression valve of the die casting unit of this embodiment is the same as the die casting unit shown in the related art, and description thereof will be omitted.

Figure 1:
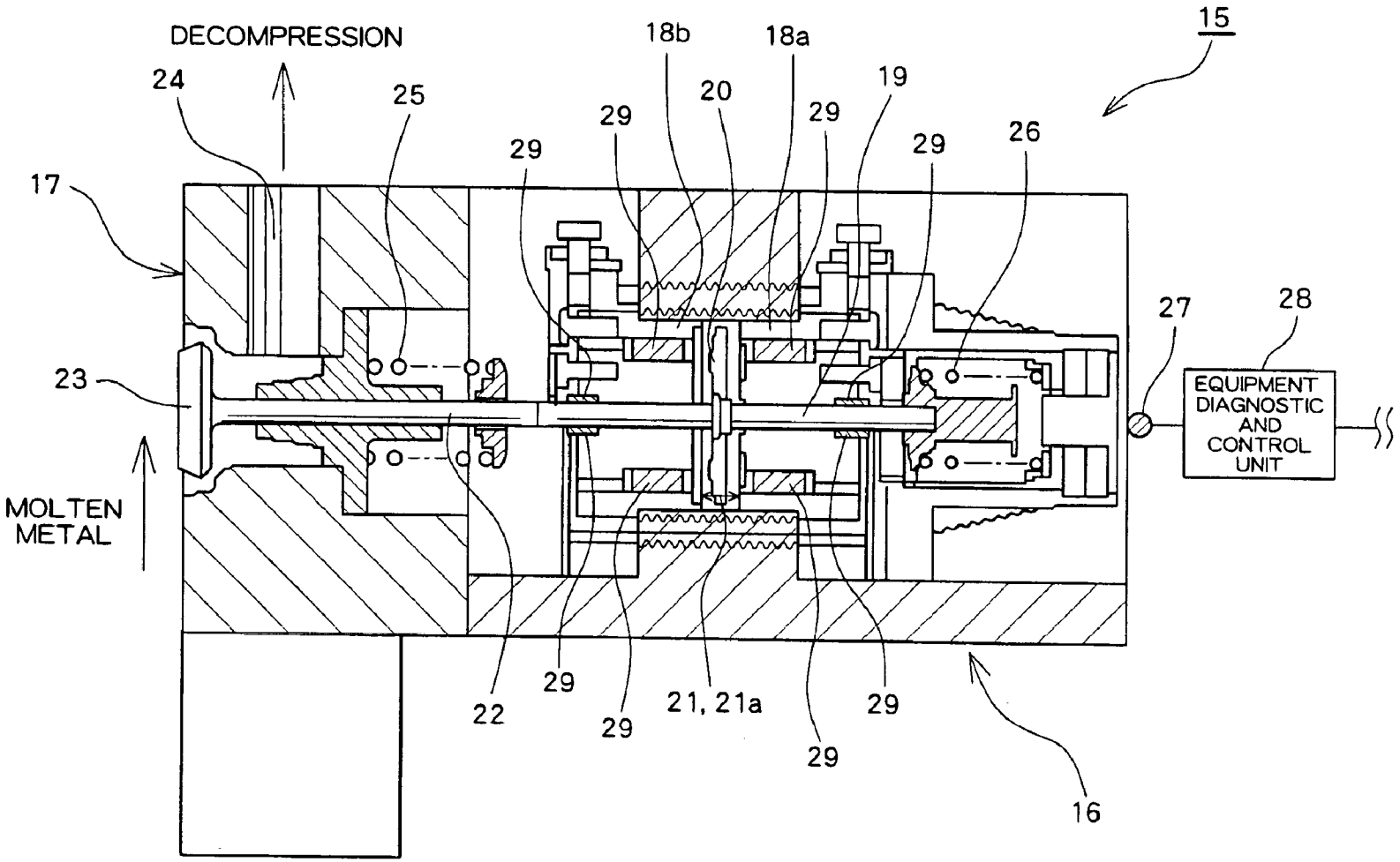
FIG. 1 is a cross-sectional schematic drawing of an electromagnetically driven die casting decompression valve of this embodiment, and shows a state where a drive shaft is not receiving electromagnetic force from a solenoid.
Figure 2:
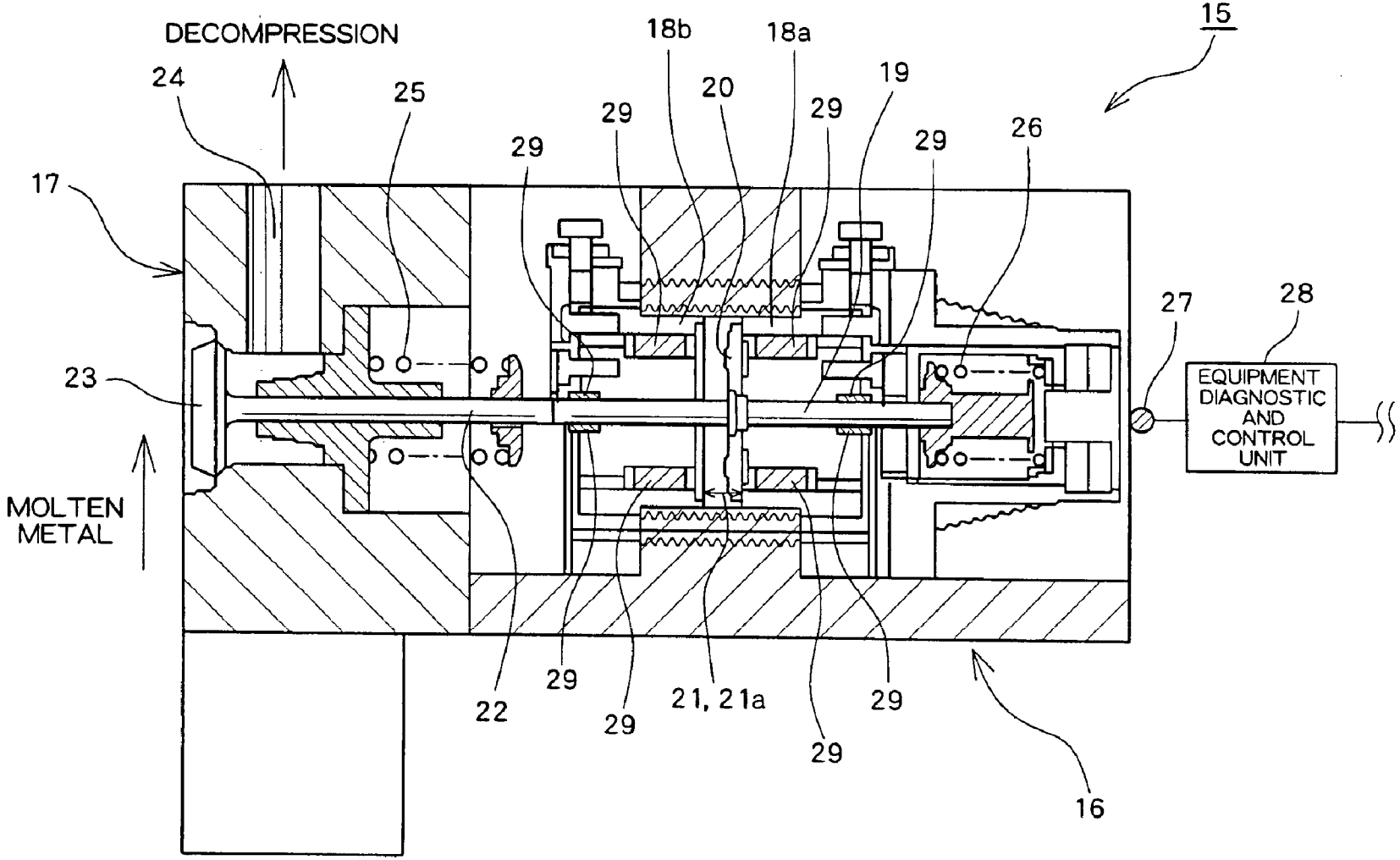
FIG. 2 is a cross-sectional schematic drawing of an electromagnetically driven die casting decompression valve of this embodiment, and shows a state where the drive shaft receives electromagnetic force from a closing solenoid and is positioned at a closed end of a drive stroke.
Figure 3:
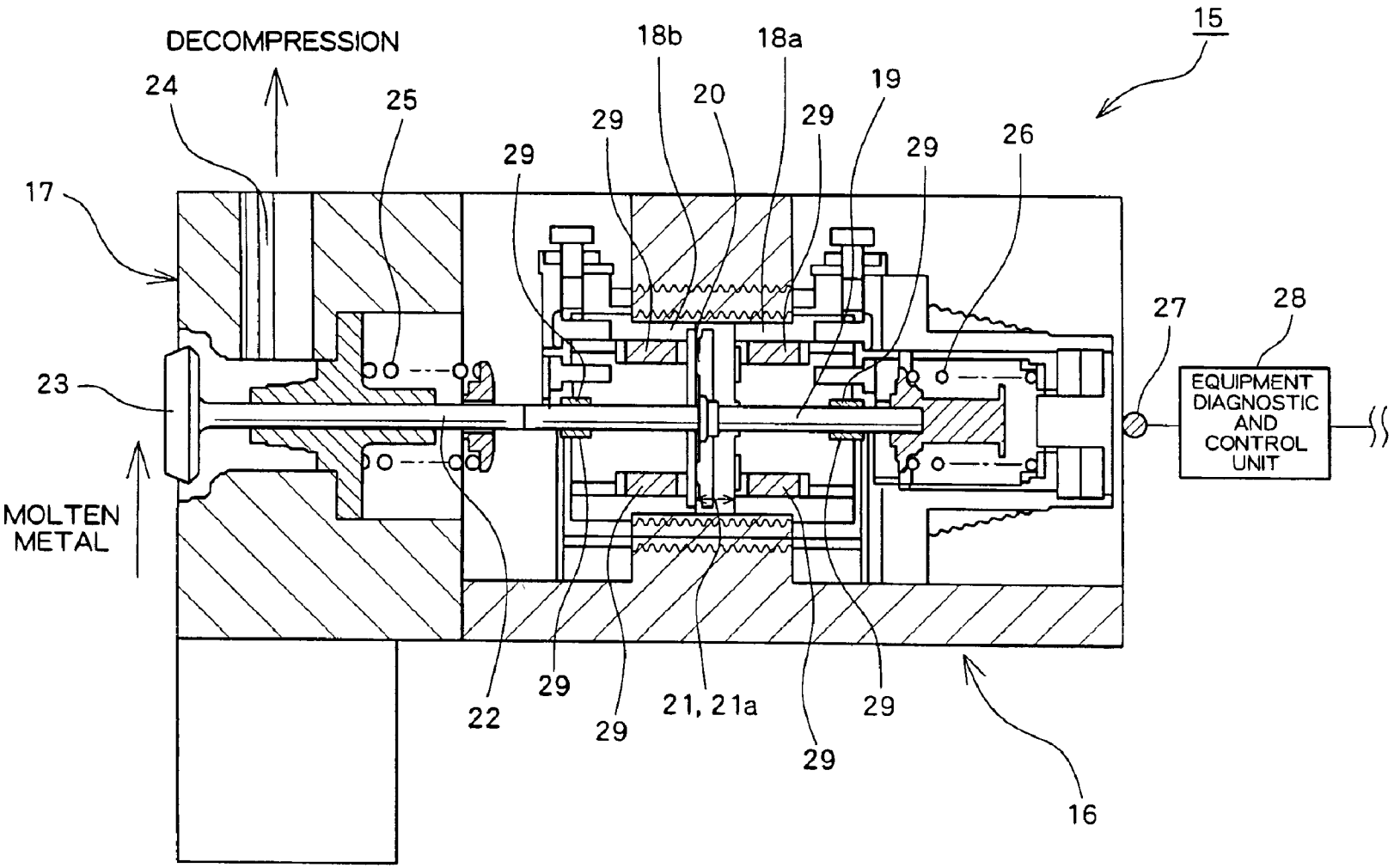
FIG. 3 is a cross-sectional schematic drawing of an electromagnetically driven die casting decompression valve of this embodiment, and shows a state where the drive shaft receives electromagnetic force from an opening solenoid and is positioned at an open end of a drive stroke.
Figure 8:
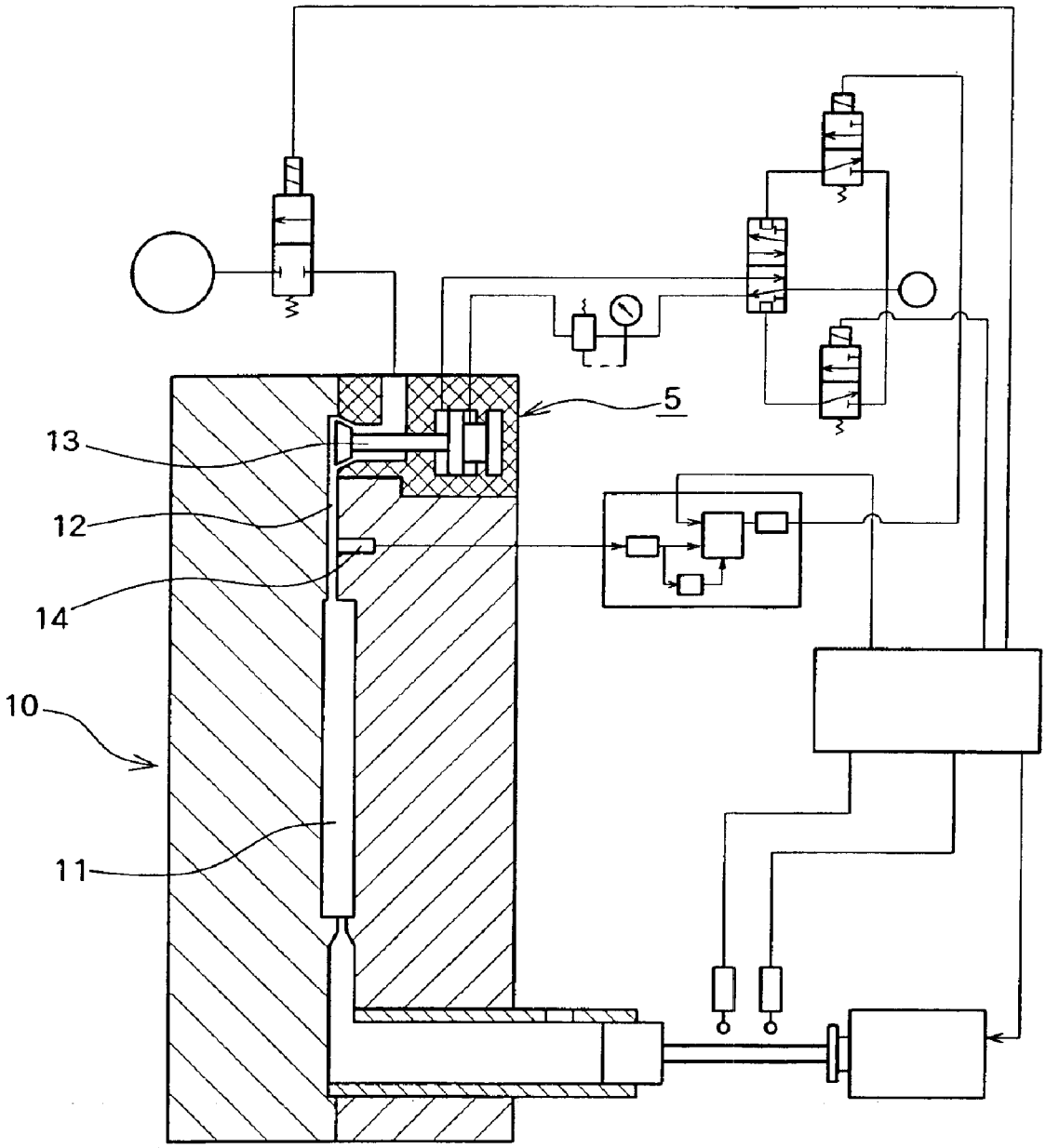
FIG. 8 is a drawing showing a die casting unit of the related art.

FIG. 1 is a cross-sectional schematic drawing of an electromagnetically driven die casting decompression valve 15 of this embodiment, and shows a state where a drive shaft 19 is not receiving electromagnetic force from solenoids 18*a*, 18*b*. Also, FIG. 2 is a cross-sectional schematic drawing of the electromagnetically driven die casting decompression valve 15 of this embodiment, and shows a state where the drive shaft 19 receives electromagnetic force from a closing solenoid 18*a* and is positioned at a closed end of a drive stroke 21*a*. FIG. 3 is a cross-sectional schematic drawing of the electromagnetically driven die casting decompression valve 15 of this embodiment, and shows a state where the drive shaft 19 receives electromagnetic force from an opening solenoid 18*b* and is positioned at an open end of a drive stroke 21*a*. The electromagnetically driven die casting decompression valve 15 of this embodiment is arranged at the same place as with the valve drive unit 5 shown in the related art (refer to FIG. 8).

A characteristic feature of the electromagnetically driven die casting decompression valve 15 of this embodiment is that the electromagnetically driven die casting decompression valve 15 has a two-block structure, made up of a drive block 16 and a valve block 17.

Two solenoids 18*a* and 18*b*, and a drive shaft 19 driven by receiving electromagnetic force from these solenoids 18*a* and 18*b*, are arranged inside the drive block 16. A sheath section 20 that extends in a radial direction is axially formed on a substantially axial center part of the drive shaft 19, arranged in a space 21 formed by the two solenoids 18*a* and 18*b*. The drive shaft 19 receiving electromagnetic force from the solenoids 18*a* and 18*b* has a movement distance regulated by this sheath section 20, and so it is possible to move only a distance of the space 21 formed by the two solenoids 18*a* and 18*b*. That is, the distance of this space 21 defines the drive stroke 21*a* through which the drive shaft is capable of moving.

On the other hand, a valve shaft 22 separate from the drive shaft 19 is arranged inside the valve block 17. A valve body 23 is provided on one shaft end of the valve shaft 22, and this valve body 23 opens and closes an inlet of an exhaust passage 24.

Also, a closing spring 25 for urging the valve body 23 in a closing direction is provided on the valve shaft 22. This closing spring 25 exerts urging force to close the inlet of the exhaust passage 24, in cooperation with the valve shaft 22. An opening spring 26 for urging the drive shaft 19 in an opening direction is also provided on the drive shaft 19. This opening spring 26 urges the valve body 23 in an opening direction, and exerts urging force to open the inlet of the exhaust passage 24, in cooperation with the drive shaft 19.

Here, the closing spring 25 and opening spring 26 described above exert urging force in opposite axial directions to each other, which means that the valve shaft imparted with urging force in a closing direction by the closing spring 25, and the drive shaft 19 imparted with urging force in an opening direction by the opening spring 26 come into contact at respective shaft ends, to maintain equilibrium. That is, in a state where the drive shaft 19 is not receiving electromagnetic force from the solenoids 18*a* and 18*b*, the shaft end surface of the valve shaft 22 that is opposite the valve body 23 mounting side and a shaft end surface of the drive shaft 19 come into contact to maintain equilibrium, and the sheath section 20 having the drive shaft 19 is arranged substantially centrally inside this drive stroke 21*a*. At this time, the valve body 23 is in a state opening the inlet of the exhaust passage 24 (state of FIG. 1).

If the solenoid 18*a* exerts electromagnetic force in a closing direction on the drive shaft 19, the drive shaft 19 moves in a closing direction against the force of the opening spring 26. At this time the valve shaft 22 is moved in the closing direction under the force of the closing spring 25, and so the valve body 23 is in a closed state closing the inlet of the exhaust passage 24 (the state of FIG. 2). Here, the force received by the valve body 23 when closing the inlet of the exhaust passage 24 is constituted by only the urging force of the closing spring 25, but this is helpful in preventing bouncing of the valve body 23 which was not possible with the related art. The bounce prevention mechanism will be described in detail using FIG. 4.

Figure 4:
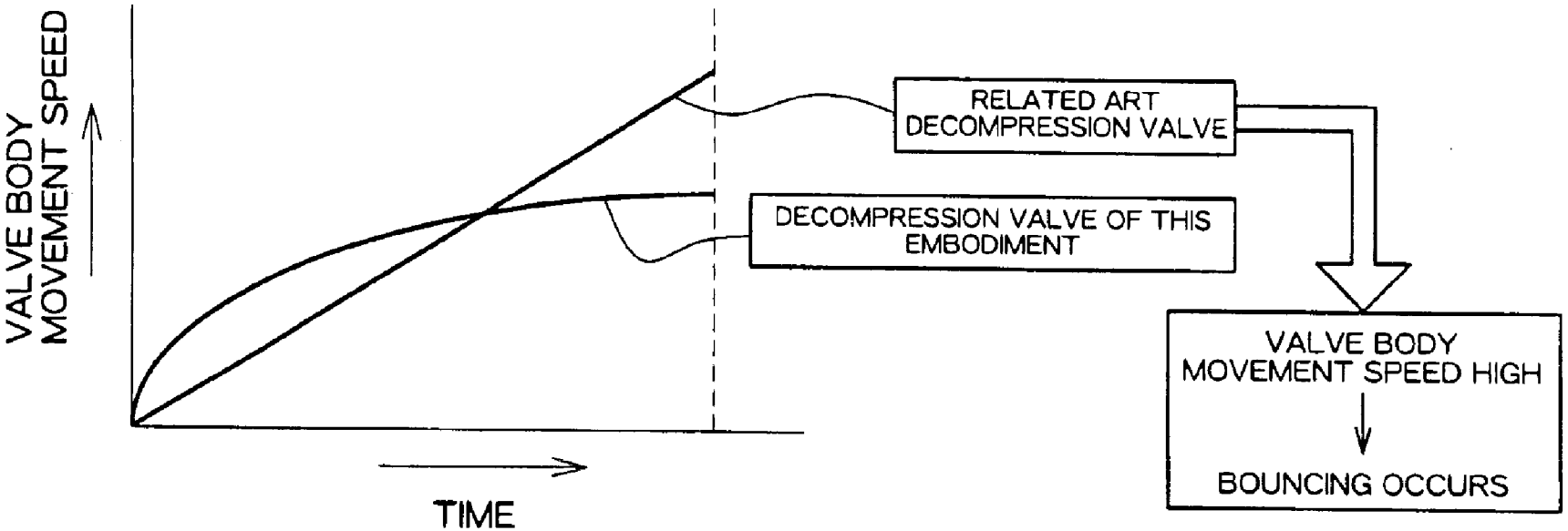
FIG. 4 is a drawing showing comparison of valve operating speed over time for a decompression valve of the related art and a decompression valve of this embodiment.

FIG. 4 is a drawing showing comparison of valve operating speed over time for a decompression valve of the related art and a decompression valve of this embodiment. In the case of the decompression valve of the related art, since movement speed of the valve body increases linearly, regardless of whether air drive or electromagnetic drive is employed, collision speed of the valve body at the time of closing the exhaust passage increases, which means that it is easy for valve bounce to occur. However, in the case of the decompression valve 15 of this embodiment, initial movement speed of the valve body 23 is high due to the effect of the closing spring 25, but since movement speed of the valve body 23 at the time of closing the exhaust passage is suppressed due to the effect of the opening spring 26 it is possible to suppress the occurrence of bounce. Also, the decompression valve of this embodiment has high initial movement speed, so compared to the decompression valve of the related art the total valve movement time required to close the exhaust passage is substantially the same, or even shorter. Accordingly, there is no effect on the decompression of the inside of the cavity, and no reduction in the quality of a cast item.

On the other hand, when opening the inlet of the exhaust passage 24, the solenoid 18*b* exerts electromagnetic force in an opening direction on the drive shaft 19, and the drive shaft 19 is made to move in an opening direction. As a result of movement of the drive shaft 19 in the opening direction, the valve shaft 22 moves in the opening direction against the force of the closing spring 25. As a result, the valve body 23 opens the inlet of the exhaust passage 24 (state of FIG. 3).

The electromagnetically driven die casting decompression valve 15 of this embodiment is also provided with a position detector 27 for detecting current position of the drive shaft in the drive stroke 21*a*, and an equipment diagnostic and control unit 28, as decompression valve control means, for drive control of the decompression valve. By using this position detector 27 and equipment diagnostic and control unit 28, it is made possible to carry out equipment diagnostics for the electromagnetically driven die casting decompression valve 15. For example, the electromagnetically driven die casting decompression valve 15 is held in the open direction at the same time as plant startup, and this state is confirmed by the position detector 27. The position detector 27 transmits position information about the drive shaft 19 to the equipment diagnostic and control unit 28 as an electrical signal, and if it is confirmed that the drive shaft 19 has stopped at the right position, the equipment diagnostic and control unit 28 starts up the die casting unit. Also, when molten metal is injected and filled using an injection piston, if the position detector 27 detects an abnormality of the drive shaft 19, the equipment diagnostic and control unit 28 instructed to stop injection to the injection piston and stops casting. By adopting this type if device structure, the occurrence of problems is prevented in advance, and it is made possible to carry out stable production activities.

Further, a characteristic of the electromagnetically driven die casting decompression valve 15 of this embodiment is that permanent magnets 29 are arranged at ends of a drive stroke 21*a* through which the drive shaft 19 is capable of being moved. These permanent magnets 29 are provided in order to stably stop the drive shaft 19 driven by electromagnetic force of the solenoids 18*a* and 18*b* at the open end and closed end of the drive stroke 21*a*. The drive shaft 19 is held at that stop position against the urging force exerted by the closing spring 25 or the opening spring 26 at the end of the drive stroke 21*a*. This holding force is created by electromagnetic force generated by the solenoids 18*a* and 18*b*, but it is possible to realize a stable stop operation of the drive shaft 19 and to reduce costs etc. by reducing the amount of electrical power supplied to the solenoids 18*a* and 18*b*, by supplementing this holding force using magnetic force of the permanents 29.

The electromagnetically driven die casting decompression valve 15 of this embodiment has various advantages compared to the decompression valve of the related art, but the advantage with respect to the occurrence of problems will be demonstrated. The electromagnetically-driven die casting decompression valve 15 of this embodiment has a two block structure, made up of a drive block 16 and a valve block 17, as described above. Therefore, in the case where molten metal infiltrates into part of the valve body 23 and it is necessary to replace a valve, it is possible to replace only the valve block 17. In the case of a decompression valve of the related art (for example, the valve drive mechanism of FIG. 8), it was necessary to replace the entire decompression valve, and there were various problems associated with decompression valve replacement such as increase in maintenance time for replacement operations. However, according to the electromagnetically driven die casting decompression valve 15 of this embodiment, it is possible to continue using the drive block 16 housing the drive mechanism of high manufacturing cost, such as the solenoids 18*a* and 18*b*, and it is possible to replace only the comparatively inexpensive valve block 17, which makes it possible to keep costs generated at the time of problems to a minimum.

First Drive Method

Figure 5:
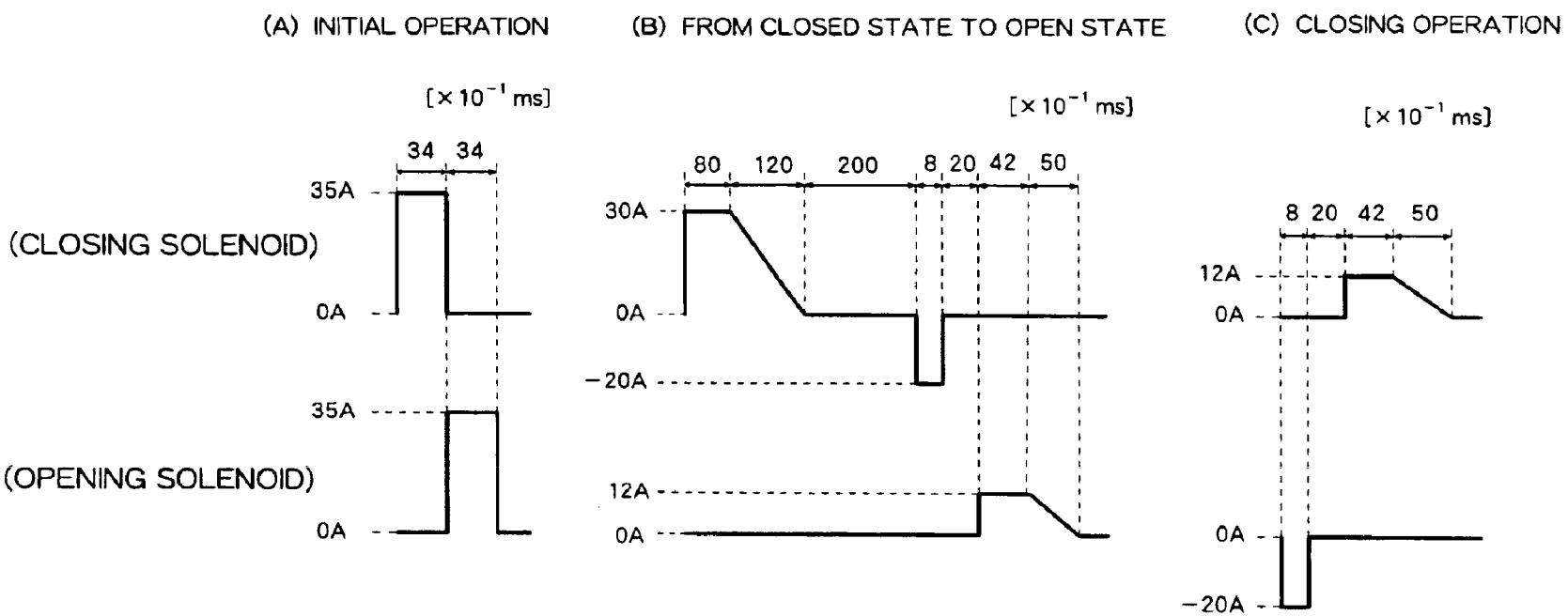
FIG. 5 is a drawing showing an example of drive signals to a solenoid when driving the electromagnetically driven die casting decompression valve of this embodiment.

Next, a drive method for the electromagnetically driven die casting decompression valve 15 of this embodiment will be described. FIG. 5 is a drawing showing an example of drive signals to solenoids 18*a* and 18*b* when driving the electromagnetically driven die casting decompression valve 15 of this embodiment.

Here, it is possible to demonstrate the above described advantage of this embodiment even if the drive signals to the solenoids 18*a* and 18*b* use two simple types of drive signal for opening and closing, but by driving the electromagnetically driven die casting decompression valve 15 using the drive signals show in FIG. 5, it is possible to use comparatively inexpensive solenoids 18*a* and 18*b*. As a result, it is possible to achieve a reduction in manufacturing costs by miniaturizing the electromagnetically driven die casting decompression valve 15. The drive conditions shown below are only examples, and the present invention is not limited to these examples.

First of all, FIG. 5(A) is an initialization operation, and a drive signal is alternately supplied to the closing solenoid 18*a* and the opening solenoid 18*b*. In FIG. 5(A), a state is shown where drive signals are supplied to the respective solenoids one at a time, but this signal is repeated about ten times. As a result of this initialization, the drive shaft is shaken so as to rock to the left and right. In this state, the valve body 23 of the electromagnetically driven die casting decompression valve 15 remains open.

Next, the electromagnetically driven die casting decompression valve 15 is driven from the closed state to the open state, as shown in FIG. 5(B). First of all, as a drive signal, a current of 30A is applied to the closing solenoid 18*a* for a duration of $80\times10^{-1}$ ms. As a result of this drive signal the drive shaft 19 moves to the closed side of the drive stroke 21*a*. After that, the current value is lowered over the course of $120\times10^{-1}$ ms. At this time, the drive shaft 19 is fixed at the closed end side by holding force of the permanent magnet 29, and the valve body 23 of the electromagnetically driven die casting decompression valve 15 is maintained in the closed state. After that, a current of −20A is applied to the closing solenoid 18*a* for a duration of $8\times10^{-1}$ ms, and after an interval of $20\times10^{-1}$ ms a current of 12A is applied to the opening solenoid 18*b* for a duration of $42\times10^{-1}$ ms. As a result of this drive signal the drive shaft 19 moves to the open side. Continuing on, the current value is lowered over the course of $50\times10^{-1}$ ms. At this time, as with the closed side, since the drive shaft 19 is fixed at the open end side by holding force of the permanent magnet 29, the valve body 23 of the electromagnetically driven die casting decompression valve 15 is maintained in the open state. In this way, after the electromagnetically driven die casting decompression valve 15 has been put in the open state, injection and filling with molten metal by decompression of the inside of the cavity 11 commences.

The inside of the cavity 11 is filled with molten metal, and if molten metal is detected by the molten metal sensor 14, the closing operation of FIG. 5(C) is implemented for the electromagnetically driven die casting decompression valve 15. First of all, a current of −20A is applied to the opening solenoid 18*b* for a duration of $8\times10^{-1}$ ms, and after an interval of $20\times10^{-1}$ ms, a current of 12A is applied to the closing solenoid 18*a* for a duration of $42\times10^{-1}$ ms. As a result of this drive signal the drive shaft 19 moves to the closed side. After that, the current value is lowered over the course of $50\times10^{-1}$ ms. At this time, since the drive shaft 19 is fixed at the closed end side by holding force of the permanent magnet 29, the valve body 23 of the electromagnetically driven die casting decompression valve 15 is maintained in the closed state. This completes a casting operation.

By supplying the drive signals as described above, operation of the electromagnetically driven die casting decompression valve 15 that keeps the amount of drive power to a minimum is made possible. A unit in which this type of operation is possible also has the effects of the closing spring 25, opening spring 26 and permanent magnets 29 possessed by the electromagnetically driven die casting decompression valve 15 of this embodiment.

Second Drive Method

Continuing on, another drive method for the electromagnetically driven die casting decompression valve 15 of this embodiment will be described. According to this drive method, even if there is a disturbance (for example, variation in friction due to attachment of aluminum powder, or variation in friction due to the effects of heat) causing improper operation of the valve shaft 22, the electromagnetically driven die casting decompression valve 15 is capable of carrying out the correct valve operation.

Figure 6A:
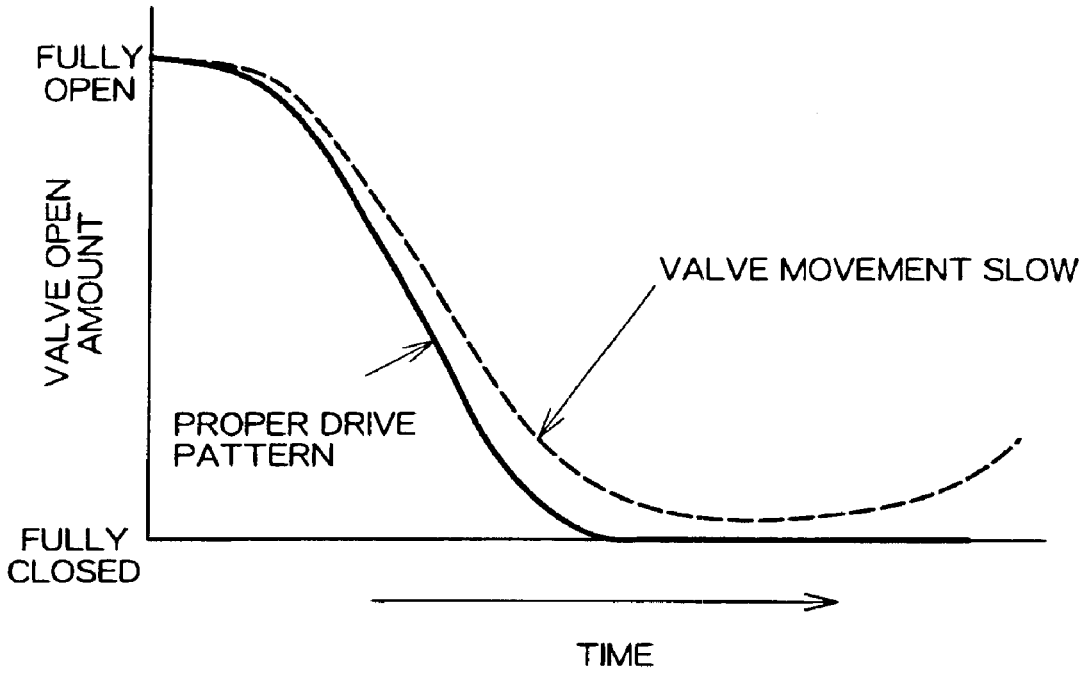
FIG. 6A is a drawing for describing improper operation of an assumed valve shaft in a second operating method.
Figure 6B:
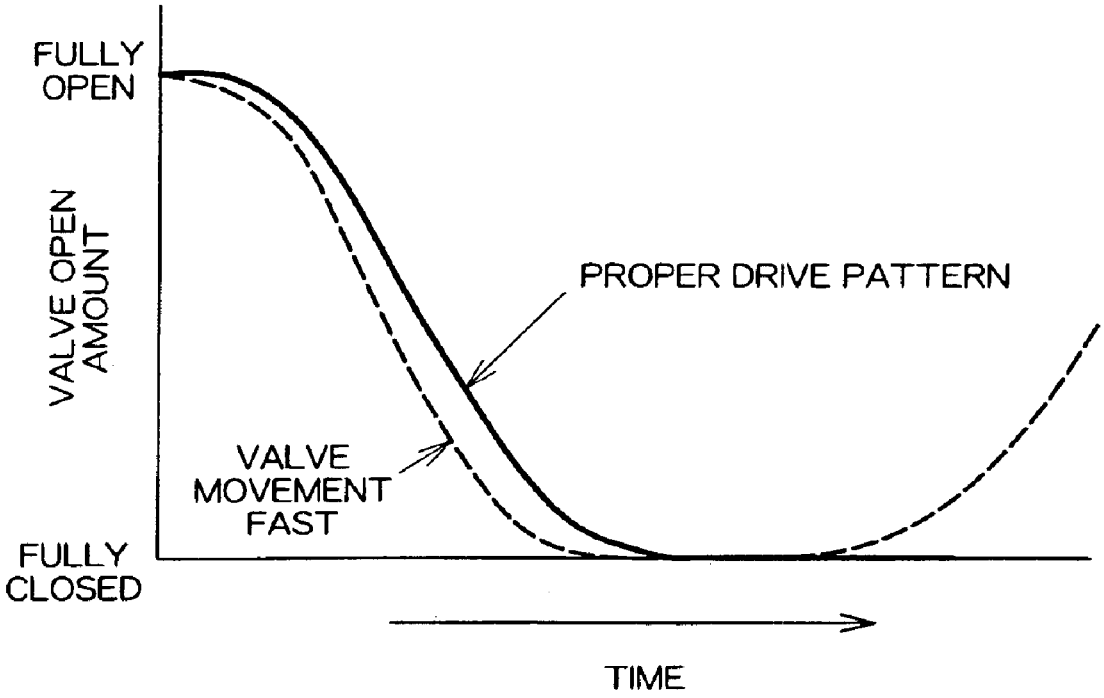
FIG. 6B is a drawing for describing improper operation of an assumed valve shaft in a second operating method.

First of all, improper operation of an assumed valve shaft 22 will be described using FIG. 6(A) and FIG. 6(B). FIG. 6(A) and FIG. 6(B) show a valve opening transition for every elapsed time.

As an improper operation for the valve shaft 23, as shown in FIG. 6, there is a case where the valve body 23 does not close completely due to movement of the valve shaft 22 becoming slow. This is an abnormality that is caused by the attachment of aluminum powder around the valve shaft 22 or valve body 23 as a result of repeated use of the electromagnetically-driven die casting decompression valve 15. Also, as shown in FIG. 6(B), improper operation also arises where movement of the valve shaft 22 becomes fast. This is an abnormality that is caused by variation in clearance of the valve body 23 as a result of increase in temperature around the electromagnetically driven die casting decompression valve 15. All of these abnormalities are connected to damage to the decompression valve 15, and so it is necessary to have a drive method that does not cause abnormalities. With this drive method, the valve body 23 is always operated with an appropriate drive pattern.

Figure 7:
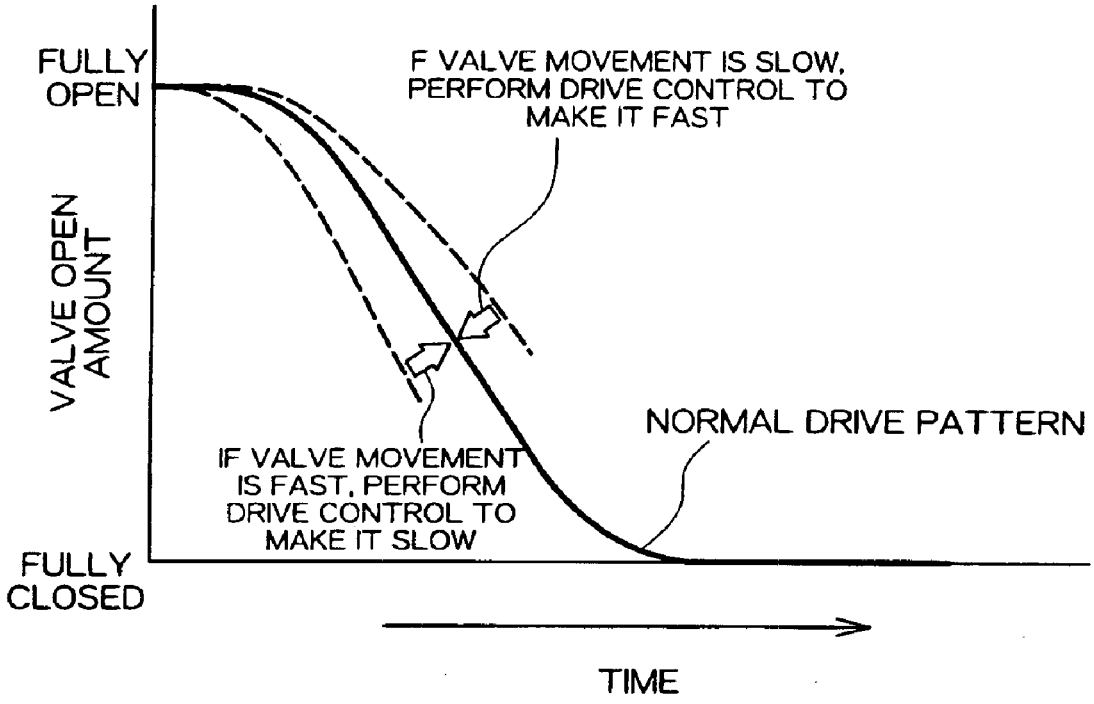
FIG. 7 is a drawing for describing the second operating method.

First of all, with this drive method, a normal drive pattern for the valve body 23, as shown by the solid line in FIG. 7, is set in advance. This normal drive pattern can be determined for each decompression valve 15 from experiment or experience.

At the time of actual operation of the valve, the actual drive pattern of the valve body 23 is detected, and the valve body is drive controlled so that this actual drive pattern matches the normal drive pattern. Specifically, in a case where there is a possibility of a complete closing operation not being carried out because the movement of the valve shaft 22 is slow, the valve body 23 is drive controlled so that the movement of the valve shaft 22 becomes fast, and in the event that the speed of the valve shaft 22 is fast, the valve body 23 is drive controlled so that the speed of the valve shaft becomes slow. By carrying out drive control of the valve body 23 in this way, the valve body 23 is operated using a drive pattern that always matches the normal drive pattern.

The normal drive pattern and the actual drive pattern are preferably represented as operational waveforms of the valve body showing valve-opening amount for every elapsed time. An actual drive pattern represented as a valve body operation waveform can be calculated by appropriation of the position detector 27, installed in order to acquire positional information about the drive shaft 19, and the equipment diagnostic and control unit 28.

For example, because the drive shaft 19 and the valve shaft 22 are in a state of contact due to urging force of two springs, namely the closing spring 25 and the opening spring 26, it is possible to acquire position information for the valve shaft 22 based on positional information for the drive shaft 19 acquired by the position detector 27. Therefore, it is possible to ascertain the valve-opening amount of the valve body 23 from the positional information for the valve shaft 22. The actual drive pattern is calculated by always acquiring this valve-opening amount. This calculation can be carried out based on positional information for the drive shaft 19 acquired as electrical signals from the position detector 27 by the equipment diagnostic and control unit 28.

On the other hand, with respect to the drive control of the valve body 23 carried out so that the normal drive pattern and the actual drive pattern match, this can be implemented by adjusting drive current applied to the solenoids 18*a* and 18*b*. Specifically, in a case where there is a possibility of a complete closing operation not being carried out because the movement of the valve shaft 22 is slow, applied current to the closing solenoid 18*a* is increased in order to make the movement of the valve shaft 22 fast, and in the event that the speed of the valve shaft 22 is fast, applied current to the closing solenoid 18*a* is reduced in order to make the speed of the valve shaft slow. With respect to drive control of the valve body 23, it is also possible to control the closing solenoid 18*a* and the opening solenoid 18*b* in combination, and not just the closing solenoid 18*a*.

With the present invention, a case where the drive shaft 19 is arranged in the drive stroke 21*a* at a position maintaining an equilibrium is given as an example, but it is also possible to have a structure where urging force of the closing spring 25 is utilized at the time of carrying out closing of the valve 23 to prevent bounce occurring, that is, to position the drive shaft 19 at a place other than the closed end of the drive stroke 21*a,* in a state where electromagnetic force is not being received from the solenoids 18*a* and 18*b.*

What is claimed is:

1. An electromagnetically driven die casting decompression valve, used for decompression of the inside of a cavity injection filled with molten metal in order to obtain a desired cast item, and fitted in an exhaust passage formed communicating with a cavity inside a mold, comprising:

a drive shaft, provided inside a drive block, driven by electromagnetic force from a solenoid; and a valve shaft, provided inside a valve block separate from the drive shaft, provided with a valve body on one shaft end, wherein a closing spring working jointly to urge the valve body in a closing direction is provided on the valve shaft, while an opening spring working jointly to urge the valve body in the opening direction is provided on the drive shaft, a shaft end surface of the drive shaft and shaft end surface of the valve shaft that is opposite to a valve mounting side are brought into contact by urging forces in opposite axial directions exerted by the closing spring and the opening spring, opening and closing of the decompression valve is carried out by driving the valve shaft connected to the drive shaft driven by the solenoid, and it is possible to replace the valve block.

2. The electromagnetic drive-type die casting decompression valve as disclosed in claim 1, wherein:

when not receiving electromagnetic force from the solenoid, the drive shaft and the valve shaft are provided maintaining an equilibrium within a drive stroke from an open end to a closed end that the valve body is capable of being driven through.

3. The electromagnetic drive-type die casting decompression valve as disclosed in claim 1, further comprising:

a position detector for detecting current position of the drive shaft within the drive stroke from an open end to a closed end that the valve body is capable of being driven through, and wherein equipment checks are carried out using electrical signals from the position detector.

4. The electromagnetic drive-type die casting decompression valve as disclosed in claim 1, wherein:

respective permanent magnets are fitted at the open end and closed end of the drive shaft, and the permanent magnets contribute towards reduction in power consumption of the solenoid by assisting stopping at a drive stroke end of the drive shaft driven by drive force generated by the solenoid.

5. A drive method, for an electromagnetic drive-type die casting decompression valve comprising a drive shaft, provided inside a drive block, driven by electromagnetic force from a solenoid, and a valve shaft, provided inside a valve block separate from the drive shaft, provided with a valve body on one shaft end, wherein a closing spring working jointly to urge the valve body in a closing direction is provided on the valve shaft, while an opening spring working jointly to urge the valve body in the opening direction is provided on the drive shaft, a shaft end surface of the drive shaft and shaft end surface of the valve shaft that is opposite to a valve mounting side are brought into contact by urging forces in opposite axial directions exerted by the closing spring and the opening spring, and opening and closing of the decompression valve is carried out by driving the valve shaft connected to the drive shaft driven by the solenoid, wherein a normal drive pattern for the valve body is set in advance, and the valve body is drive controlled so that an actual drive pattern of the valve body calculated based on measurement results of a position detector fitted in order to detect valve opening amount matches the normal drive pattern.

6. The drive method for an electromagnetic drive-type die casting decompression valve, as disclosed in claim 5, wherein:

the normal drive pattern and the actual drive pattern are represented as operational waveforms of the valve body showing valve opening amount for every elapsed time.

7. The drive method for an electromagnetic drive-type die casting decompression valve, as disclosed in claim 5, wherein:

the drive control of the valve body carried out so that the normal drive pattern and the actual drive pattern match, is carried out by adjusting drive current applied to the solenoids.

8. A die casting unit, used to obtain desired cast items by decompressing a cavity formed inside a mold and injecting and filling molten metal into the cavity, comprising:

an exhaust passage formed communicating with the cavity inside a mold;

a decompression valve for opening and closing the exhaust passage;

and decompression valve control means for drive controlling the decompression valve, wherein the decompression valve comprises a drive shaft, provided inside a drive block, driven by electromagnetic force from a solenoid; and a valve shaft, provided inside a valve block separate from the drive shaft, provided with a valve body on one shaft end, wherein a closing spring working jointly to urge the valve body in a closing direction is provided on the valve shaft, while an opening spring working jointly to urge the valve body in the opening direction is provided on the drive shaft, a shaft end surface of the drive shaft and shaft end surface of the valve shaft that is opposite to a valve mounting side are brought into contact by urging forces in opposite axial directions exerted by the closing spring and the opening spring, and opening and closing of the decompression valve is carried out by driving the valve shaft connected to the drive shaft driven by the solenoid, and it is possible to replace the valve block.

* * * * *